US009132305B2

(12) United States Patent
Feenstra

(10) Patent No.: US 9,132,305 B2
(45) Date of Patent: Sep. 15, 2015

(54) FIRE PROTECTION SPRINKLER

(75) Inventor: Shawn J. Feenstra, Caledonia, MI (US)

(73) Assignee: THE VIKING CORPORATION, Hastings, MI (US)

( * ) Notice: Subject to any disclaimer, the term of this patent is extended or adjusted under 35 U.S.C. 154(b) by 559 days.

(21) Appl. No.: 12/405,623

(22) Filed: Mar. 17, 2009

(65) Prior Publication Data

US 2010/0236795 A1 Sep. 23, 2010

(51) Int. Cl.

| | |
|---|---|
| ***A62C 37/08*** | (2006.01) |
| ***A62C 37/36*** | (2006.01) |
| ***A62C 37/12*** | (2006.01) |
| ***A62C 35/68*** | (2006.01) |
| ***A62C 37/11*** | (2006.01) |
| *B05B 1/26* | (2006.01) |

(52) U.S. Cl.

CPC ..... *A62C 35/68* (2013.01); *A62C 37/11* (2013.01); *B05B 1/267* (2013.01)

(58) Field of Classification Search

CPC ..... A62C 35/68; A62C 37/11; B05B 1/267
USPC ..... 169/41, 37, 56, 57, 58, 40, 38, 90, 39, 169/42, 59, 60, 61, DIG. 3; 239/498, 461, 239/476, 482, 483, 499, 500, 501, 504, 507, 239/518, 523, 524, 521, 522, 207, 208, 209
See application file for complete search history.

(56) References Cited

U.S. PATENT DOCUMENTS

| | | | | |
|---|---|---|---|---|
| 720,013 | A | | 2/1903 | Esty |
| 733,646 | A | | 7/1903 | Hibbard |
| 776,614 | A | | 12/1904 | Phelps |
| 1,498,139 | A | | 6/1924 | Williams |
| 2,076,483 | A | | 4/1937 | Rowley |
| 2,135,138 | A | * | 11/1938 | Kendall ..... 239/498 |
| 2,211,399 | A | | 8/1940 | Winslow |
| 2,389,333 | A | | 11/1945 | Tyden |
| 2,534,066 | A | | 12/1950 | Rowley |
| 3,561,537 | A | | 2/1971 | Dix et al. |
| 3,682,251 | A | | 8/1972 | Livingston |
| 4,296,815 | A | | 10/1981 | Mears |
| 4,405,018 | A | | 9/1983 | Fischer |
| 4,580,729 | A | | 4/1986 | Pounder |
| 5,036,923 | A | | 8/1991 | Shea, Sr. |
| 5,152,344 | A | | 10/1992 | Fischer et al. |

(Continued)

FOREIGN PATENT DOCUMENTS

WO WO2008/131356 * 10/2008

*Primary Examiner* — Len Tran
*Assistant Examiner* — Steven M Cernoch
(74) *Attorney, Agent, or Firm* — Harness, Dickey & Pierce, P.L.C.

(57) ABSTRACT

A fire protection sprinkler includes a sprinkler body having a fluid passage extending therethrough. A plug member disposed in the fluid passage. A heat responsive unit releasably secures the plug member in the fluid passage. A pair of frame arms extend from the sprinkler body. A deflector is mounted to the pair of frame arms and includes a peripheral edge including a plurality of slots extending radially inward from the peripheral edge. The plurality of slots include a pair of slots orthogonal to the pair of frame arms and the deflector includes a pair of apertures radially inward of the pair of slots and orthogonal to the pair of frame arms. The pair of apertures include an inner arcuate portion and a radially outwardly extending portion extending from the inner arcuate portion.

22 Claims, 2 Drawing Sheets

(56) References Cited

U.S. PATENT DOCUMENTS

Figure 1:
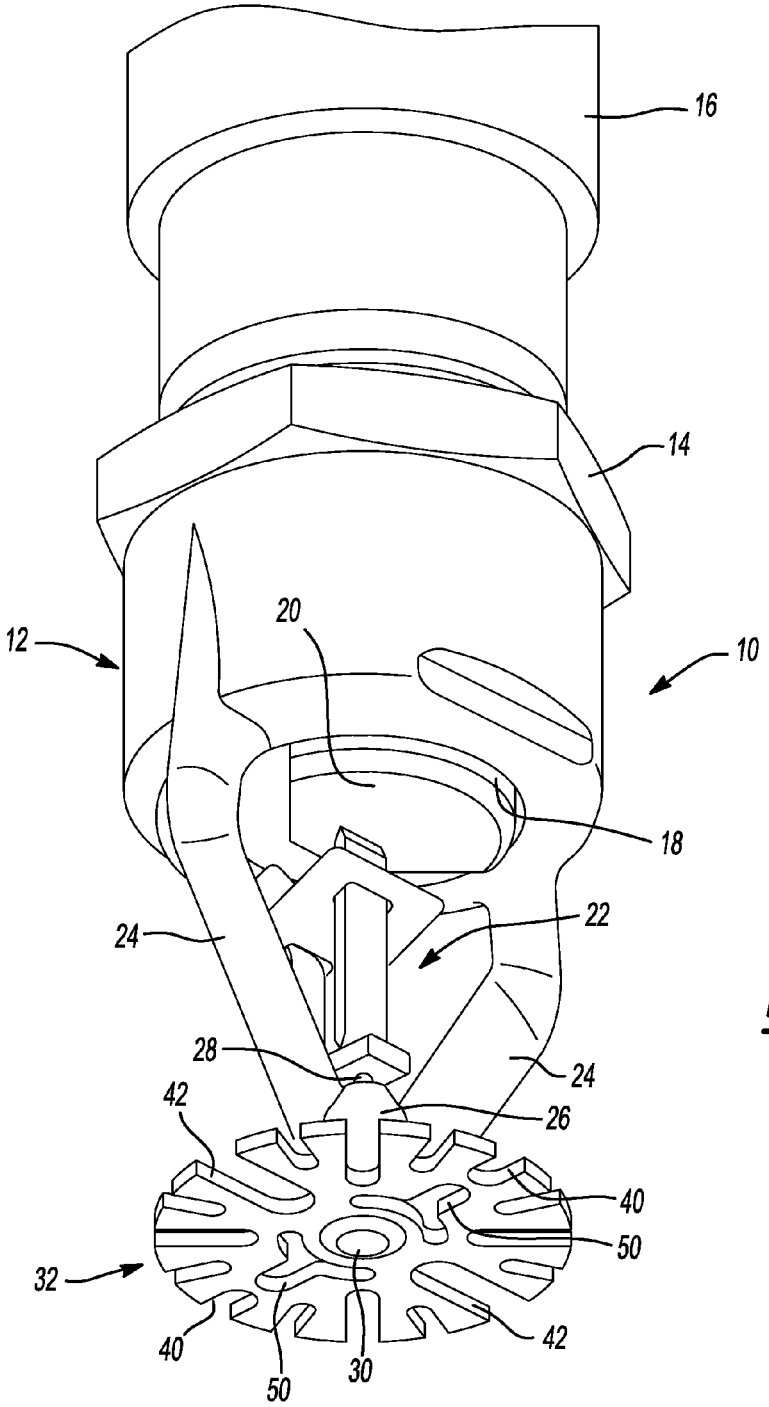

| | | | | | |
|---|---|---|---|---|---|
| 5,203,416 | A | | 4/1993 | Takeuchi et al. | |
| 5,366,022 | A | * | 11/1994 | Meyer et al. | 169/37 |
| 5,392,993 | A | | 2/1995 | Fischer | |
| 5,810,263 | A | | 9/1998 | Tramm | |
| 5,829,684 | A | * | 11/1998 | Fishcer | 239/524 |
| 5,839,667 | A | * | 11/1998 | Fishcer | 239/498 |
| 5,865,256 | A | * | 2/1999 | Pounder | 169/37 |
| 6,026,907 | A | | 2/2000 | Pahila | |
| 6,059,044 | A | | 5/2000 | Fischer | |
| 6,276,460 | B1 | * | 8/2001 | Pahila | 169/37 |
| 6,516,893 | B2 | * | 2/2003 | Pahila | 169/37 |
| 6,854,668 | B2 | | 2/2005 | Wancho et al. | |
| 7,165,624 | B1 | * | 1/2007 | Fischer | 169/37 |
| 7,201,234 | B2 | * | 4/2007 | Rogers et al. | 169/37 |
| 7,624,812 | B2 | * | 12/2009 | Pahila | 169/37 |
| 2005/0145394 | A1 | * | 7/2005 | Wancho et al. | 169/37 |
| 2007/0169945 | A1 | * | 7/2007 | Rogers et al. | 169/37 |
| 2007/0246232 | A1 | * | 10/2007 | Pahila | 169/37 |
| 2009/0126950 | A1 | * | 5/2009 | Rogers | 169/46 |

* cited by examiner

FIRE PROTECTION SPRINKLER

FIELD

The present disclosure relates to a fire protection sprinkler, and more particularly to a fire protection sprinkler having a deflector design for providing a desired water distribution pattern.

BACKGROUND

This section provides background information related to the present disclosure which is not necessarily prior art.

Fire protection sprinklers are designed and widely used for commercial and residential applications to control or suppress a fire. In commercial applications there are environmental conditions that can dictate which types of sprinklers are utilized in the commercial environment. The commercial application can include a hazard type or commodity that is being stored in the commercial environment, the ceiling height, the height of storage that can be stacked on racks, the presence of obstructions, the coverage area needed to be protected, the spacing between the sprinkler heads and the available water supply. For residential applications, the coverage area, spacing, water supply, ceiling type, as well as other aesthetic concerns may apply. The National Fire Protection Association (NFPA) provides standards that define the minimum requirements for the designing and installation of automatic fire sprinkler systems. One type of fire protection system is a fire suppression system in which the sprinkler system is designed to sharply reduce the heat release rate of a fire and prevent its re-growth by means of direct and sufficient application of water or other fire suppressant through the fire plume to the burning fuel source. A fire control system is designed to limit the size of a fire by distribution of water so as to decrease the heat release rate and pre-wet adjacent combustibles while controlling ceiling gas temperatures to avoid structural damage. The NFPA provides different standards for fire suppression and fire control.

Both Underwriters Laboratories (UL) and Factory Mutual Approvals (FM) provide fire testing of sprinkler designs for meeting their intended design purpose. For successful fire suppression or control tests performed at UL or FM, the tests provide baseline data for water distribution and response time requirements for future designs intended to meet the same design requirements. The baselines are used to establish water distribution requirements for testing of the future sprinklers and these baseline water distribution requirements are determined based upon water distribution tests of the sprinkler heads that were tested to successfully control or suppress a fire as required. The sprinkler characteristics that are important for meeting design requirements typically include the required delivered density (RDD), the actual delivered density (ADD), the thermal sensitivity of the sprinkler, and the operating time of the sprinkler. In general, if a subsequently designed sprinkler has the same or improved water distribution in order to meet the required delivered density and actual delivered density requirements, and the sprinkler's thermal sensitivity and operating time are within the required limits, the sprinkler design can be approved without the necessity for conducting further actual fire tests which can be very expensive and time consuming.

Each different sprinkler type demands a different type of water spray pattern to achieve either fire control or suppression. Standard coverage ordinary hazard sprinklers generally protect a maximum coverage area of 130 square feet. According to the guidelines of the NFPA, extended coverage ordinary hazard sprinklers must protect from 225 to 400 square feet. Several factors can influence the water distribution patterns of a sprinkler. The different spray patterns achieved by different sprinkler types are provided by varying such factors as the shape of the sprinkler frame, the K-factor, and the geometry of the deflector position below the frame for creating a spray pattern. For applications where more water is required for control or suppression, the K factor is increased to meet the demand for additional water. In addition, the water supply pressure may also be increased or decreased to meet the demands.

The deflector geometry is particularly significant since the deflector is the main component of the sprinkler assembly and to a great extent, defines the size, shape, uniformity, and water droplet size of the pattern. Often times, a new sprinkler design can be achieved by utilizing an existing deflector geometry and/or by making minor modifications to the lengths or widths of the slots provided in the deflector. However, with some sprinkler designs, a simple modification of an existing deflector geometry does not adequately provide the water distribution pattern necessary for a desired application.

SUMMARY

This section provides a general summary of the disclosure, and is not a comprehensive disclosure of its full scope or all of its features.

A fire protection sprinkler includes a sprinkler body having a fluid passage extending therethrough. A plug member is disposed in the fluid passage. A heat responsive unit releasably secures the plug member in the fluid passage. A pair of frame arms can extend from the sprinkler body. A deflector is mounted to the pair of frame arms and includes a peripheral edge including a plurality of slots extending radially inward from the peripheral edge. The plurality of slots include a pair of slots orthogonal to the pair of frame arms and the deflector includes a pair of apertures radially inward of the pair of slots and orthogonal to the pair of frame arms. The pair of apertures include an inner arcuate portion and a radially outwardly extending portion extending from the inner arcuate portion.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 2:
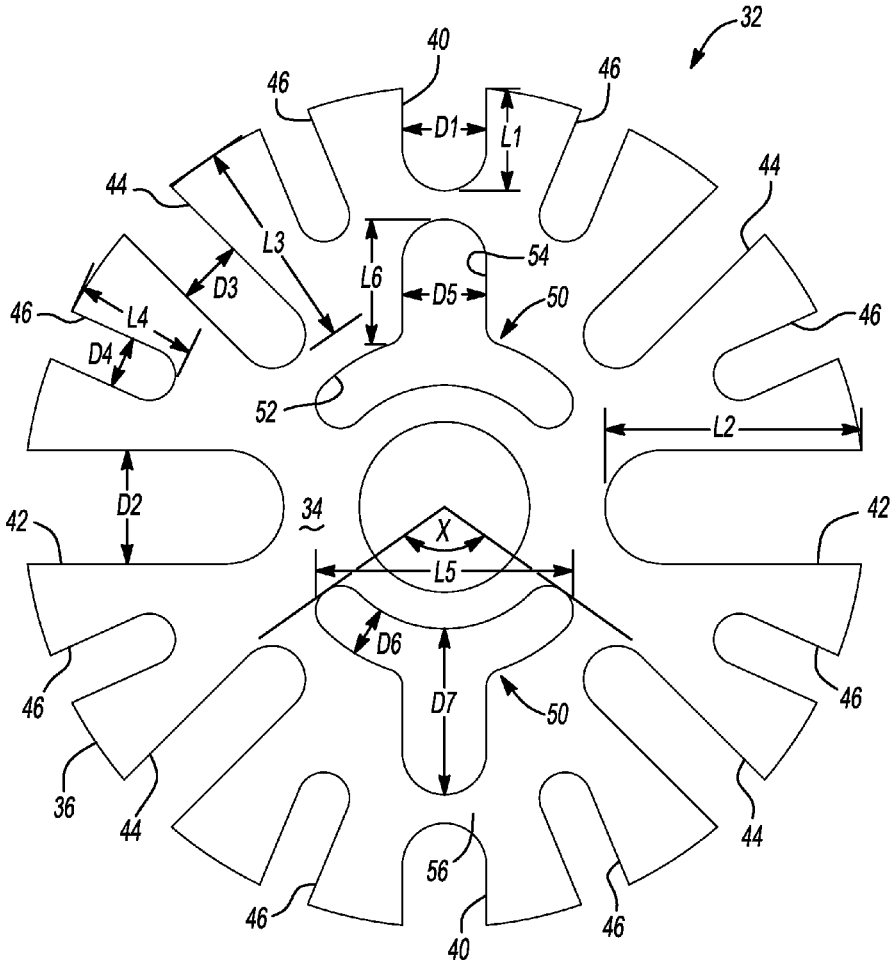

FIG. 1 is a perspective view of a fire protection sprinkler according to the principles of the present disclosure; and FIG. 2 is a plan view drawn to scale of a deflector for use with a fire protection sprinkler shown in FIG. 1.

Corresponding reference numerals indicate corresponding parts throughout the several views of the drawings.

DETAILED DESCRIPTION

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIGS. 1 and 2, the fire protection sprinkler, according to the principles of the present disclosure, will now be described. The fire protection sprinkler 10 includes a sprinkler body 12 having a fluid passage extending therethrough, the fluid passage having an inlet end 14 adapted for connection with a fluid piping system 16, and an outlet end 18. A plug member 20 is disposed in the fluid passage and is releasably secured therein by a heat responsive unit 22. A pair of frame arms 24 extend from the sprinkler body 12 and can terminate at an apex 26. The heat responsive unit 22 extends between the plug member 20 and a set screw 28 that is threadedly inserted through a threaded aperture 30 in the apex 26. A deflector 32 is mounted to the apex 26.

With reference to FIG. 2, the deflector 32 will now be described in greater detail. The deflector 32 can be formed from a flat plate 34, although other shapes that are non-planar can be utilized. The deflector 32 includes a peripheral edge 36 and can include a plurality of opposed slot pairs 40, 42, 44, and 46 extending radially inward from the peripheral edge 36. In the exemplary embodiment shown, the pair of slots 40 can be orthogonal to the frame arms 24 and can have a diameter D1 and a length L1. A second pair of the plurality of slots 42 are aligned with the frame arms 24 and can have a diameter D2 greater than the first diameter D1 of the pair of slots 40 and a length L2 greater than the length L1. The slot pairs 44 can be offset 45 degrees from the frame arms 24. The slot pairs 44 can have a diameter D3 and a length L3 than is narrower and shorter than the diameter D2 and the length L2 of the slots 42. The slots 46 can be offset 22.5 degrees from each of the slots 44 and can have a diameter D4 and length L4 that can be shorter and narrower than the diameter D3 and length L3 of the slots 44, as illustrated. It should be noted that other slot arrangements can be used depending upon the specific application and that the slot widths and lengths can be changed to meet the desired water distribution pattern.

The deflector 32 further includes a pair of apertures 50 extending through the deflector 32 and disposed radially inward from the pair of slots 40 and orthogonal to the frame arms 24. The apertures 50 include an inner arcuate portion 52. The arcuate portion 52 can have a center of curvature located generally at the center of the deflector 32. A radially outwardly extending portion 54 can extend radially in an outward direction from a mid portion of the arcuate portion 52 and toward the slots 40. The radially outwardly extending portion can have a pair of parallel sidewalls and a diameter D5 that can be equal to the diameter D1 of the slots 40. A web portion 56 is disposed between the slots 40 and the apertures 50. The arcuate portion 52 can have a maximum length dimension L5, as illustrated in FIG. 2, that is at least twice a diameter D5 of the radially outwardly extending portion 54 and can be more than three times the diameter D5. The radially outwardly extending portion 54 can extend from the arcuate portion 52 a distance L6 that can be greater than the length L1 of the slots 40. The arcuate portion 52 can have a diameter D6 that is less than one-half of a radial dimension D7 of the apertures 50, as shown in FIG. 2. The arcuate portion 52 can traverse an arc that extends at an angle X (as shown in FIG. 2) of at least 50 degrees relative to a center of the deflector 32 and can be at least 90 degrees and can be approximately 110 degrees or more, depending upon the specific application.

It is noted that the sprinkler body can have a nominal K-factor of 14, although larger and smaller K-factors can be utilized depending upon the application of the designed sprinkler 10. Furthermore, the heat responsive unit 22 can be designed to provide a response time index of 35 $m/s^2$ or less, although other response time indexes exceeding 35 $m/s^2$ can be utilized depending upon a specific application. Applicants further note that the heat responsive unit 22 as shown is a linkage-type heat responsive unit which is well known in the art. It is contemplated that other heat responsive units can be utilized with the design of the present disclosure, as it is typically within the level of ordinary skill in the art for a sprinkler designer to modify a sprinkler to accommodate various types of existing heat responsive units in order to achieve desired heat sensitivity and response time indexes depending upon different applications. It should also be noted that the deflector of the present disclosure can be used with other sprinkler bodies that may or may not include frame arms as shown in the exemplary embodiment.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A fire protection sprinkler, comprising:

a sprinkler body having a fluid passage extending therethrough, said fluid passage having an inlet end and an outlet end;

a plug member disposed in said fluid passage;

a heat responsive unit releasably securing said plug member in said fluid passage;

a pair of frame arms extending from said sprinkler body; and a deflector mounted to said pair of frame arms, said deflector including a peripheral edge including a plurality of open ended slots extending radially inward from and opening to said peripheral edge, said plurality of open ended slots including a first pair of open ended slots directly aligned in a first plane with said pair of frame arms and having a first length and a second pair of open ended slots in a second plane directly orthogonal to said pair of frame arms and passing through a center of said deflector, said second pair of open ended slots having a second length (L1) shorter than said first length, said deflector including a pair of apertures radially inward of said second pair of open ended slots and orthogonal to said pair of frame arms, said pair of apertures having a radial outer edge and a radial inner edge and defining a radial dimension (D7) from said radial outer edge to said radial inner edge along said second plane that is greater than said second length (L1).

2. The fire protection sprinkler according to claim 1, wherein said pair of apertures include an inner arcuate portion.

3. The fire protection sprinkler according to claim 2, wherein said inner arcuate portion of said pair of apertures has a center of curvature generally at a center of said deflector.

4. A fire protection sprinkler, comprising:

a sprinkler body having a fluid passage extending therethrough, said fluid passage having an inlet end and an outlet end;

a plug member disposed in said fluid passage;

a heat responsive unit releasably securing said plug member in said fluid passage;

a pair of frame arms extending from said sprinkler body;

a deflector mounted to said pair of frame arms, said deflector including a peripheral edge including a plurality of open ended slots extending radially inward from said peripheral edge, said plurality of slots including a first pair of open ended slots directly aligned in a first plane with said pair of frame arms and having a first length and a second pair of open ended slots in a second plane directly orthogonal to said pair of frame arms and passing through a center of said deflector, said second pair of open ended slots having a second length shorter than said first length, said deflector including a pair of apertures radially inward of said second pair of open ended slots and orthogonal to said pair of frame arms;

wherein said pair of apertures include an inner arcuate portion having a radial inner edge and a radially outer edge; and wherein said pair of apertures further include a radially outwardly extending portion having a pair of side walls extending radially outward from said radially outer edge of said inner arcuate portion, said radially outwardly extending portion being in a same plane as said second pair of open ended slots, said inner arcuate portion having a maximum length dimension (L5) linearly between opposite ends of said inner arcuate portion that is longer than a diameter (D5) between said pair of sidewalls of said radially outwardly extending portion.

5. A fire protection sprinkler, comprising:

a sprinkler body having a fluid passage extending therethrough, said fluid passage having an inlet end and an outlet end;

a plug member disposed in said fluid passage;

a heat responsive unit releasably securing said plug member in said fluid passage;

a pair of frame arms extending from said sprinkler body;

a deflector mounted to said pair of frame arms, said deflector including a peripheral edge including a plurality of open ended slots extending radially inward from said peripheral edge, said plurality of slots including a first pair of open ended slots directly aligned in a first plane with said pair of frame arms and having a first length and a second pair of open ended slots in a second plane directly orthogonal to said pair of frame arms and passing through a center of said deflector, said second pair of open ended slots having a second length shorter than said first length, said deflector including a pair of apertures radially inward of said second pair of open ended slots and orthogonal to said pair of frame arms;

wherein said pair of apertures include an inner arcuate portion having an inner edge and an outer edge;

wherein said pair of apertures further include a radially outwardly extending portion having a pair of sidewalls extending radially outward from said outer edge of said inner arcuate portion, said radially outwardly extending portion being in a same plane as said second pair of open ended slots, said inner arcuate portion having a maximum length dimension (L5) linearly between opposite ends of said inner arcuate portion that is longer than a diameter (D5) between said pair of sidewalls of said radially outwardly extending portion; and wherein said radially outwardly extending portion of said pair of apertures has a same diameter as said second pair of open ended slots.

6. A fire protection sprinkler, comprising:

a sprinkler body having a fluid passage extending therethrough, said fluid passage having an inlet end and an outlet end;

a plug member disposed in said fluid passage;

a heat responsive unit releasably securing said plug member in said fluid passage;

a pair of frame arms extending from said sprinkler body;

a deflector mounted to said pair of frame arms, said deflector including a peripheral edge including a plurality of open ended slots extending radially inward from said peripheral edge, said plurality of slots including a first pair of open ended slots directly aligned in a first plane with said pair of frame arms and having a first length and a second pair of open ended slots in a second plane directly orthogonal to said pair of frame arms and passing through a center of said deflector, said second pair of open ended slots having a second length shorter than said first length, said deflector including a pair of apertures radially inward of said second pair of open ended slots and orthogonal to said pair of frame arms;

wherein said pair of apertures include an inner arcuate portion having a radially inner edge and a radially outer edge;

wherein said pair of apertures further include a radially outwardly extending portion having a pair of side walls extending radially outward from said radially outer edge of said inner arcuate portion, said radially outwardly extending portion being in a same plane as said second pair of open ended slots; and wherein said inner arcuate portion has a maximum length dimension (L5) linearly between opposite ends of said inner arcuate portion that is at least twice a width diameter (D5) between said pair of side walls of said radially outwardly extending portion.

7. A fire protection sprinkler, comprising:

a sprinkler body having a fluid passage extending therethrough, said fluid passage having an inlet end and an outlet end;

a plug member disposed in said fluid passage;

a heat responsive unit releasably securing said plug member in said fluid passage;

a pair of frame arms extending from said sprinkler body;

a deflector mounted to said pair of frame arms, said deflector including a peripheral edge including a plurality of open ended slots extending radially inward from said peripheral edge, said plurality of slots including a first pair of open ended slots directly aligned in a first plane with said pair of frame arms and having a first length and a second pair of open ended slots in a second plane directly orthogonal to said pair of frame arms and passing through a center of said deflector, said second pair of open ended slots having a second length (L1) shorter than said first length, said deflector including a pair of apertures radially inward of said second pair of open ended slots and orthogonal to said pair of frame arms;

wherein said pair of apertures include an inner arcuate portion having a radially inner edge and a radially outer edge;

wherein said pair of apertures further include a radially outwardly extending portion having a pair of sidewalls extending radially outward from said radially outer edge of said inner arcuate portion, said radially outwardly extending portion being in a same plane as said second pair of open ended slots, said inner arcuate portion having a maximum length dimension (L5) linearly between opposite ends of said inner arcuate portion that is longer than a diameter (D5) between said pair of sidewalls of said radially outwardly extending portion; and wherein said radially outwardly extending portion extends from said inner arcuate portion a first distance (L6) from said radially outer edge of said inner arcuate portion to a radially outer most edge of the radially outwardly extending portion which is greater than said second length (L1) of said second pair of open ended slots.

8. A fire protection sprinkler, comprising:

a sprinkler body having a fluid passage extending therethrough, said fluid passage having an inlet end and an outlet end;

a plug member disposed in said fluid passage;

a heat responsive unit releasably securing said plug member in said fluid passage;

a pair of frame arms extending from said sprinkler body;

a deflector mounted to said pair of frame arms, said deflector including a peripheral edge including a plurality of open ended slots extending radially inward from said peripheral edge, said plurality of slots including a first pair of open ended slots directly aligned in a first plane with said pair of frame arms and having a first length and a second pair of open ended slots in a second plane directly orthogonal to said pair of frame arms and passing through a center of said deflector, said second pair of open ended slots having a second length shorter than said first length, said deflector including a pair of apertures radially inward of said second pair of open ended slots and orthogonal to said pair of frame arms;

wherein said pair of apertures include an inner arcuate portion having a radially inner edge and a radially outer edge;

wherein said pair of apertures further include a radially outwardly extending portion including a pair of sidewalls extending radially outward from said radially outer edge of said inner arcuate portion, said radially outwardly extending portion being in a same plane as said second pair of open ended slots, said inner arcuate portion having a maximum length dimension (L5) linearly between opposite ends of said inner arcuate portion that is longer than a diameter (D5) between said pair of sidewalls of said radially outwardly extending portion; and wherein said arcuate portion has a diameter (D6) between said radially inner edge and said radially outer edge that is less than one-half of a radial dimension (D7) from said radially inner edge of said inner arcuate portion to a radially outermost edge of said radially outwardly extending portion of said pair of apertures.

9. The fire protection sprinkler according to claim 2, wherein said arcuate portion traverses an arc that extends an angle of at least 50 degrees relative to a center of said deflector.

10. The fire protection sprinkler according to claim 2, wherein said arcuate portion traverses an arc that extends an angle of at least 90 degrees relative to a center of said deflector.

11. The fire protection sprinkler according to claim 2, wherein said arcuate portion traverses an arc that extends an angle of approximately 110 degrees relative to a center of said deflector.

12. A fire protection sprinkler, comprising:

a sprinkler body having a fluid passage extending therethrough, said fluid passage having an inlet end and an outlet end;

a plug member disposed in said fluid passage;

a heat responsive unit releasably securing said plug member in said fluid passage;

a pair of frame arms extending from said sprinkler body; and a deflector mounted to said pair of frame arms, said deflector including a peripheral edge including a plurality of open ended slots extending radially inward from and opening to said peripheral edge, said plurality of open ended slots including a pair of open ended slots in a first plane directly passing through a center of said deflector and orthogonal to a second plane passing through a center of said pair of frame arms, said deflector including a pair of apertures radially inward of said pair of open ended slots and in said first plane directly orthogonal to said second plane passing through said pair of frame arms, said pair of apertures having a radial outer edge and a radial inner edge defining a radial dimension (D7) from said radial outer edge to said radial inner edge along said first plane that is greater than a length (L1) of said pair of open ended slots.

13. The fire protection sprinkler according to claim 12, wherein said pair of apertures include an inner arcuate portion having a radially inner edge and a radially outer edge.

14. The fire protection sprinkler according to claim 13, wherein said inner arcuate portion has a center of curvature generally at a center of said deflector.

15. A fire protection sprinkler, comprising:

a sprinkler body having a fluid passage extending therethrough, said fluid passage having an inlet end and an outlet end;

a plug member disposed in said fluid passage;

a heat responsive unit releasably securing said plug member in said fluid passage;

a pair of frame arms extending from said sprinkler body; and a deflector mounted to said pair of frame arms, said deflector including a peripheral edge including a plurality of open ended slots extending radially inward from and opening to said peripheral edge, said plurality of open ended slots including a pair of open ended slots in a first plane directly passing through a center of said deflector and orthogonal to a second plane passing through a center of said pair of frame arms, said deflector including a pair of apertures radially inward of said pair of open ended slots and in said first plane directly orthogonal to said second plane passing through said pair of frame arms, said pair of apertures having a radial outer edge and a radial inner edge defining a radial dimension (D7) from said radial outer edge to said radial inner edge along said first plane that is greater than a length (L1) of said pair of open ended slots;

wherein said pair of apertures include an inner arcuate portion having a radially inner edge and a radially outer edge; and wherein said pair of apertures further include a radially outwardly extending portion having a pair of sidewalls extending radially outward from said radially outer edge of said inner arcuate portion, said radially outwardly extending portion being in a same plane as said pair of open ended slots.

16. The fire protection sprinkler according to claim 15, wherein said radially outwardly extending portion of said pair of apertures has a same diameter between said pair of sidewalls as said pair of open ended slots.

17. The fire protection sprinkler according to claim 15, wherein said inner arcuate portion has a maximum length dimension linearly between opposite ends of said inner arcuate portion that is at least twice a width diameter between said pair of sidewalls of said radially outwardly extending portion.

18. The fire protection sprinkler according to claim 15, wherein said radially outwardly extending portion extends from said radially outer edge of said inner arcuate portion a first distance which is greater than said length (L1) of said pair of open ended slots.

19. The fire protection sprinkler according to claim 15, wherein said inner arcuate portion has a diameter (D6) between the radially inner edge and the radially outer edge that is less than one-half of a radial dimension (D7) from said radially inner edge to radially outermost edge of said radially outwardly extending portion of said pair of apertures.

20. The fire protection sprinkler according to claim 13, wherein said arcuate portion traverses an arc that extends an angle of at least 50 degrees relative to a center of said deflector.

21. The fire protection sprinkler according to claim 13, wherein said arcuate portion traverses an arc that extends an angle of at least 90 degrees relative to a center of said deflector.

22. The fire protection sprinkler according to claim 13, wherein said arcuate portion traverses an arc that extends an angle of approximately 110 degrees relative to a center of said deflector.

* * * * *